US010138694B2

(12) United States Patent
Homma et al.

(10) Patent No.: US 10,138,694 B2
(45) Date of Patent: Nov. 27, 2018

(54) DRILLING DEVICE AND UNLOAD CONTROL PROGRAM

(71) Applicant: Furukawa Rock Drill Co., Ltd., Chuo-ku, Tokyo (JP)

(72) Inventors: Masatoshi Homma, Takasaki (JP); Hiroki Ishikawa, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 180 days.

(21) Appl. No.: 15/113,625

(22) PCT Filed: Dec. 26, 2014

(86) PCT No.: PCT/JP2014/006497

§ 371 (c)(1),
(2) Date: Jul. 22, 2016

(87) PCT Pub. No.: WO2015/114726

PCT Pub. Date: Aug. 6, 2015

(65) Prior Publication Data

US 2017/0009542 A1 Jan. 12, 2017

(30) Foreign Application Priority Data

Jan. 31, 2014 (JP) ..... 2014-017279

(51) Int. Cl.
*E21B 7/02* (2006.01)
*E21B 21/08* (2006.01)
*E21B 44/00* (2006.01)

(52) U.S. Cl.
CPC ..... *E21B 21/08* (2013.01); *E21B 7/025* (2013.01); *E21B 44/00* (2013.01)

(58) Field of Classification Search
CPC ..... E21B 7/025
(Continued)

(56) References Cited

U.S. PATENT DOCUMENTS 5,944,122 A 8/1999 Cheers
6,860,730 B2 3/2005 Leppanen
(Continued)

FOREIGN PATENT DOCUMENTS

JP 2009-534556 A 9/2009
WO 03/093699 A1 11/2003
(Continued)

OTHER PUBLICATIONS

English translation of International Preliminary Report on Patentability in PCT/JP2014/006496 dated Aug. 11, 2016.
(Continued)

*Primary Examiner* — Taras P Bemko
(74) *Attorney, Agent, or Firm* — Young Basile Hanlon & MacFarlane, P.C.

(57) ABSTRACT

A drilling device with improved fuel efficiency, reduced impact on the environment, and the like is provided. Specifically, a drilling device performs unload control of a compressor when an engine starts up, and brings the air pressure in an air tank to a first air pressure. Moreover, the air pressure in the air tank is kept at the first air pressure while the engine is driven and a flushing mechanism is not driven. In addition, unload control of the compressor is performed when the flushing mechanism starts up, and the air pressure in the air tank is increased to a second air pressure that is higher than the first air pressure. For example, the first air pressure and the second air pressure are a low pressure (0.5 MPa) and a high pressure (1.03 MPa), respectively.

9 Claims, 6 Drawing Sheets

(58) Field of Classification Search
USPC ..... 175/24
See application file for complete search history.

(56) References Cited

U.S. PATENT DOCUMENTS

| | | | |
|---|---|---|---|
| 2009/0071715 | A1 | 3/2009 | Sormunen et al. |
| 2011/0255994 | A1 | 10/2011 | Field et al. |

FOREIGN PATENT DOCUMENTS

| | | | |
|---|---|---|---|
| WO | 2009/077656 | A1 | 6/2009 |
| WO | 2011/148051 | A1 | 12/2011 |

OTHER PUBLICATIONS

Extended European Search Report in EP 14880958 (PCT/JP/2014/006497) dated Apr. 20, 2017, 11 pp.
English translation of International Preliminary Report on Patentability in PCT/JP2014/006497 dated Aug. 11, 2016.

DRILLING DEVICE AND UNLOAD CONTROL PROGRAM

TECHNICAL FIELD

The present invention relates to unload control of a compressor in a drilling device.

BACKGROUND

At sites of mining, quarrying, construction work, or the like, drilling devices, such as a crawler drill, to drill blast holes in rock are used. On a drilling device, a rock drill (drifter) is mounted on a guide shell. A rock drill is provided with a striking mechanism and a rotating mechanism and is loaded with a rod at the tip of which a bit is attached.

In the drilling of the rock drill, a blow is given to the bit at the tip of the rod by means of the striking mechanism to produce a shock wave while rotating the bit at the tip of the rod by means of the rotating mechanism to change the phase of the bit that contacts bedrock to apply the shock wave to the bedrock to break up the bedrock. Since the tip of the bit crushes rock to produce cuttings during the drilling, the rock drill performs flushing (removal of cuttings).

SUMMARY

Since compressed air is used in flushing, a compressor that compresses air is mounted on a drilling device. Since a compressor needs a large quantity of starting power and frequently turning on and off the compressor and thus increases a power loss, load/unload control is performed in general. For example, when air pressure in an air tank reaches a preset upper limit, an unloader (capacity adjustment device) that controls the compressor operation works to push open a suction valve plate, and, when the air pressure reaches a preset lower limit during idling, pushing down of the suction valve plate is stopped and the compressor is brought to a compression operation mode.

In general, in a drilling device, an engine and a compressor are directly connected to each other. After the engine starts up, the air pressure in the air tank is kept at a low pressure (0.5 MPa). The reason for the engine and the compressor being directly connected to each other is that there is no available clutch capable of withstanding the demanded power of the compressor or capable of transferring the demanded power for the compressor and fits in a limited space in the machine body.

Thereafter, at the point when a compressor switch (SW) is turned on, unload control of the compressor is performed, the air pressure in the air tank is brought from the low pressure to a high pressure (1.03 MPa), and the state is kept until the engine stops. The compressor switch is used for turning on and off a pulse jet that is used for cleaning a bag filter or the like in a dust collector and for turning on and off an air pressure (high/low pressure) switching function of the compressor. When the compressor switch is off, the compressor is always unloaded at a low pressure.

However, keeping the air pressure in the air tank at the high pressure (1.03 MPa) needs more energy than keeping the air pressure at the low pressure (0.5 MPa). Loads on the compressor and the air tank are also larger. After decompressing compressed air supplied from the air tank to a predetermined air pressure (0.5 MPa) by means of a decompression valve, the pulse jet injects the decompressed air into the dust collector. Hence, waste and loss of energy are large.

In a field of drilling devices for a drilling operation, efficiency of drilling operation has been regarded as most important conventionally. However, importance is also placed on the fuel efficiency, impact on the environment, and the like these days. Therefore, with regard to the unload control of a compressor, the unload control is demanded in consideration of the fuel efficiency, impact on the environment, and the like.

An object of the present invention is to provide a drilling device in which the fuel efficiency, reduced impact on the environment, and the like are improved.

A drilling device according to one mode of the present invention performs unload control of a compressor to bring air pressure in an air tank to a first air pressure when an engine starts up and keeps the air pressure in the air tank at the first air pressure until flushing is performed. For example, the air pressure in the air tank is kept at the first air pressure even when dust removal by a pulse jet is performed in a dust collector. The drilling device performs unload control of the compressor to increase the air pressure in the air tank to a second air pressure that is higher than the first air pressure when a flushing mechanism starts up. For example, the first air pressure and the second air pressure are a low pressure (0.5 MPa) and a high pressure (1.03 MPa), respectively.

The drilling device may perform the unload control of the compressor to decrease the air pressure in the air tank from the second air pressure to the first air pressure when the flushing mechanism is stopped.

A program for unload control according to one mode of the present invention is a program to make a computer mounted on a drilling device execute processing for the above-described drilling device. The program for unload control can be stored in a storage device and/or a storage medium.

According to one aspect of the present invention, in a drilling device, automatically performing unload the control, while keeping air pressure at a low pressure even when a compressor switch for dust removal by a pulse jet is turned on. The air pressure is increased to a high pressure only when the high pressure is needed as in flushing. This configuration enables improved fuel efficiency, reduced impact on the environment, and the like.

BRIEF DESCRIPTION OF THE DRAWINGS

FIG. 3A is a schematic view illustrating a processing procedure (when flushing is performed) of unload control in which importance is placed on fuel efficiency, impact on the environment, and the like.

FIG. 3B is a schematic view illustrating a processing procedure (when a pulse jet is used) of the unload control in which the importance is placed on fuel efficiency, impact on the environment, and the like.

DETAILED DESCRIPTION

Hereinafter, embodiments of the present invention will be described with reference to the accompanying drawings. Note that, in the description of the drawings, identical or similar symbols are assigned to identical or similar portions. However, it should be noted that the drawings are schematically illustrated and can be different from actual ones.

In addition, the following embodiments illustrate devices and methods to embody the technical idea of the present invention by way of example. The technical idea of the present invention is not limited to the materials, shapes, structures, arrangements, or the like of the constituent components to those described below. The technical idea of the present invention can be subjected to a variety of modifications and changes within the technical scope prescribed by the claims.

Figure 1:
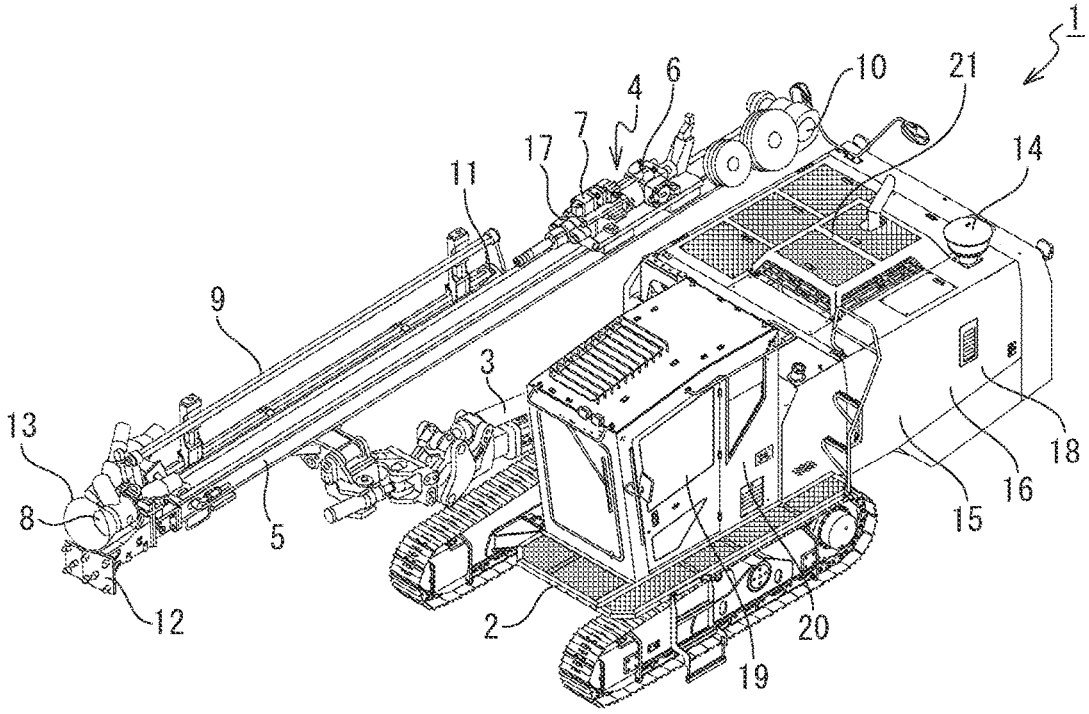
FIG. 1 is a perspective view of a crawler drill that is an example of a drilling device.
Figure 2:
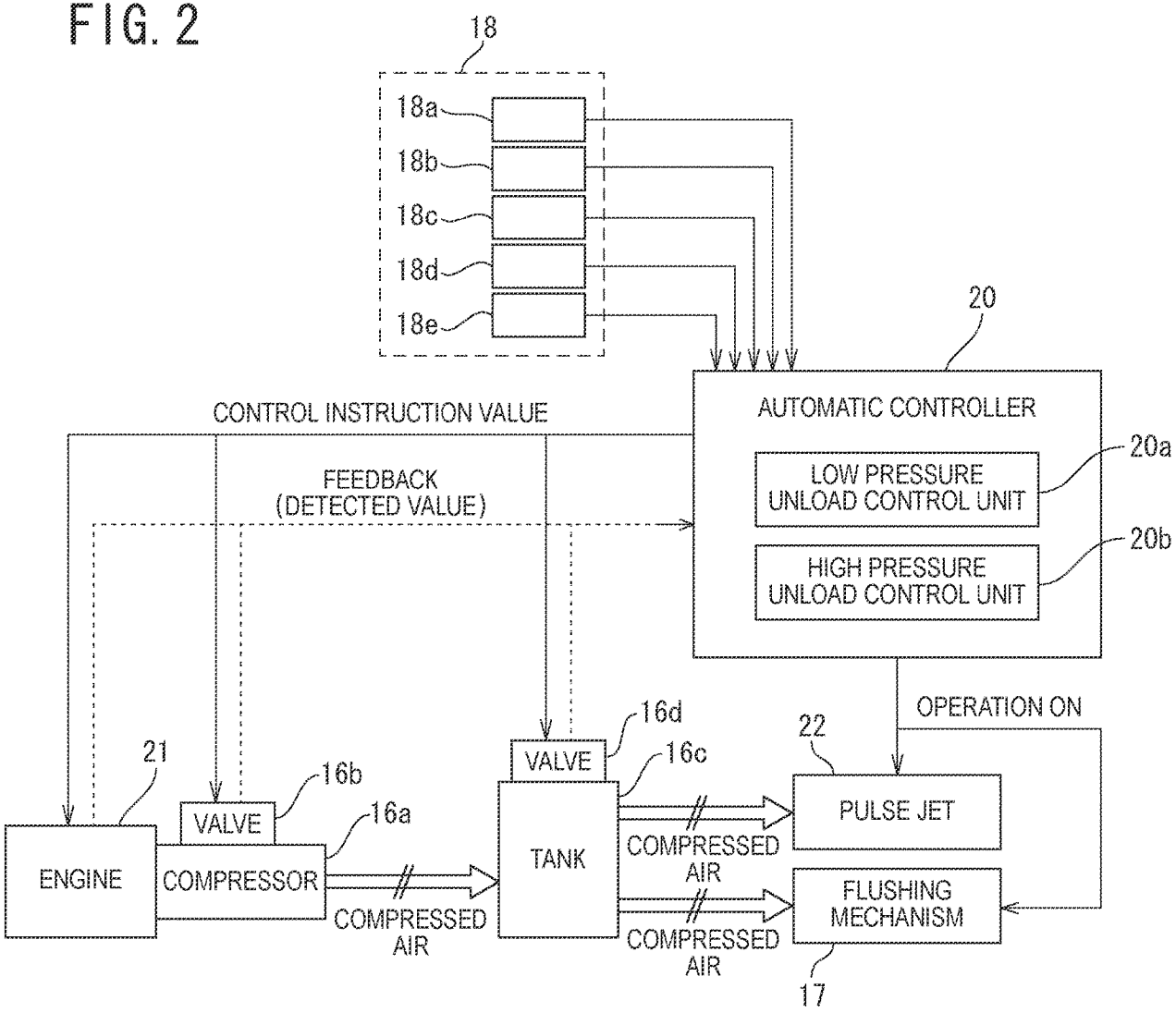
FIG. 2 is a diagram illustrating a configuration example of an automatic controller mounted on the crawler drill.

FIG. 1 is a perspective view of a crawler drill that is an example of a drilling device in one embodiment. FIG. 2 is a block diagram illustrating a configuration example of an automatic controller mounted on the crawler drill.

A crawler drill 1 includes a boom 3 mounted to a front portion of a carriage 2. The boom 3 supports, at the tip portion, a guide shell 5 on which a rock drill (drifter) 4 is mounted. The rock drill 4 includes a striking mechanism 6 and a rotating mechanism 7 and is loaded with a rod 9 to the tip of which a bit 8 is attached.

The rock drill 4 is given feed by a feed mechanism 10, which is mounted on the guide shell 5, and moves on a drilling axis in the front and rear direction along the guide shell 5. In the drilling of the rock drill 4, the striking mechanism 6 delivers a blow to the bit 8 at the tip of the rod 9 to produce a shock wave, and the rotating mechanism 7 rotates the bit 8 at the tip of the rod 9 to change the phase of the bit 8 contacting bedrock, and delivers the shock wave to the bedrock to break up the bedrock.

At a middle portion of the guide shell 5, a rod changer 11, which includes the rod 9, is mounted eccentrically from the drilling axis. When a drilling length is longer than the length of the rod 9, the rod 9 is elongated and retrieved by the rod changer 11 in the drilling operation.

At the tip of the guide shell 5, a foot pad 12 is mounted. During drilling, pressing the foot pad 12 at the tip of the guide shell 5 against bedrock prevents the guide shell 5 from wobbling because of the drilling.

Above the foot pad 12, a suction cap 13 is mounted on the drilling axis. Inside the suction cap 13, the bit 8 is housed, and, at the back thereof, a through hole to couple the bit 8 and the rod 9 is formed.

Since the tip of the bit 8 crushes the rock to produce cuttings during the drilling, the boom 3 presses the suction cap 13 at the tip of the guide shell 5 against the surface of the bedrock. The suction cap 13, which covers the mouth of a drilled hole, prevents cuttings from scattering at the surface of bedrock.

On a rear portion of the carriage 2, a dust collector 14, a hydraulic control unit 15, and a pneumatic control unit 16 that are driven on the basis of engine rotation are mounted (built in). The dust collector 14 is connected to the suction cap 13 via a cuttings transport pipe (not illustrated) and configured to collect cuttings by means of the cuttings transport pipe. The hydraulic control unit 15, by uses of a hydraulic system, drives the striking mechanism 6, the rotating mechanism 7, the feed mechanism 10, and the rod changer 11. Herein, a hydraulic drifter and a hydraulic feed motor are respectively used as the rock drill 4 and the feed mechanism 10. The pneumatic control unit 16 compresses air and supplies the compressed air.

In one embodiment, the pneumatic control unit 16 includes a compressor 16*a*, a suction valve 16*b*, an air tank 16*c*, and a release valve 16*d*, as illustrated in FIG. 2.

The compressor 16*a* is a compressor configured to compress the air to generate the compressed air. The suction valve 16*b* is a valve configured to suck in the air by the compressor 16*a*. For example, the suction valve 16*b* opens and closes an air inlet. The air tank 16*c* is configured to accumulate the compressed air supplied by the compressor 16*a* to stably supply the compressed air. The release valve 16*d* is configured to release the compressed air in the air tank 16*c* to adjust the air pressure. In practice, however, the configuration of the pneumatic control unit 16 is not limited to the above-described examples.

Furthermore, the rock drill 4 includes a flushing mechanism 17, which is supplied with the compressed air from the pneumatic control unit 16. In the drilling operation, the flushing mechanism 17 is configured to supply the compressed air for flushing from the inside of the rock drill 4 to the rod 9 and onward to the bit 8 at the tip thereof, and to discharge cuttings on the surface of bedrock.

The rod 9 and the bit 8 have hollow bodies, in each of which a cavity or a tube that serves as a passage for compressed air is formed on the inside thereof. As described above, the suction cap 13 covers the mouth of a drilled hole to prevent the cuttings from scattering on the surface of bedrock. The dust collector 14 is configured to collect the cuttings by way of the cuttings transport pipe connected to the suction cap 13.

As detectors 18 configured to detect striking pressure, rotational pressure, feed speed (feed length), feed pressure, and flushing pressure of the rock drill 4, a rotational pressure detector 18*a*, a feed speed detector 18*b*, a feed pressure detector 18*c*, and a striking pressure detector 18*d* are mounted on the hydraulic control unit 15, and a flushing pressure detector 18*e* is mounted on the pneumatic control unit 16.

On the carriage 2, an operator cabin 19 and an automatic controller 20 configured to control the operation of the crawler drill 1 are mounted. A driving seat and a display device, not illustrated, for an operator are mounted inside the operator cabin 19. The display device may be a touch panel. In practice, to enable remote manipulation and wireless manipulation, a communication device or the like may be provided.

In the automatic controller 20, a computer that has functions of storage, operation, and control is used. The rotational pressure detector 18*a*, the feed speed detector 18*b*, the feed pressure detector 18*c*, the striking pressure detector 18*d*, and the flushing pressure detector 18*e* are connected with the automatic controller 20, as illustrated in FIG. 2. The automatic controller 20 is configured to control the suction valve 16*b*, the release valve 16*d*, and the engine 21 to detect feedback (detected value), as illustrated in FIG. 2.

In one embodiment of the present invention, the automatic controller 20 includes a low pressure unload control unit 20*a* and a high pressure unload control unit 20*b*, as illustrated in FIG. 2.

The low pressure unload control unit 20*a* brings the air pressure in the air tank 16*c* to a low-pressure state (0.5 MPa). The low pressure corresponds to a first air pressure. For example, the low pressure unload control unit 20*a* is configured to perform unload control of the compressor 16*a* to bring the air pressure in the air tank 16*c* to the low pressure when the engine 21 starts up (turns on), and keeps the air pressure in the air tank 16*c* at the low pressure (keeps it constant) even when a compressor switch (SW) is turned on. The reason for the air pressure in the air tank 16*c* being brought to the low pressure when the engine starts up is to prevent burning of the compressor 16*a*. In one embodiment of the present invention, the low pressure unload control unit 20*a* sets the low pressure to a pressure necessary for lubrication of the compressor 16*a*.

The high pressure unload control unit 20*b* brings the air pressure in the air tank 16*c* to a state of high pressure (1.03 MPa). The high pressure corresponds to a second air pressure. For example, the high pressure unload control unit 20*b* performs unload control of the compressor 16*a* to bring the air pressure in the air tank 16*c* to the high pressure when the flushing mechanism 17 starts up (turns on).

Figure 3A:
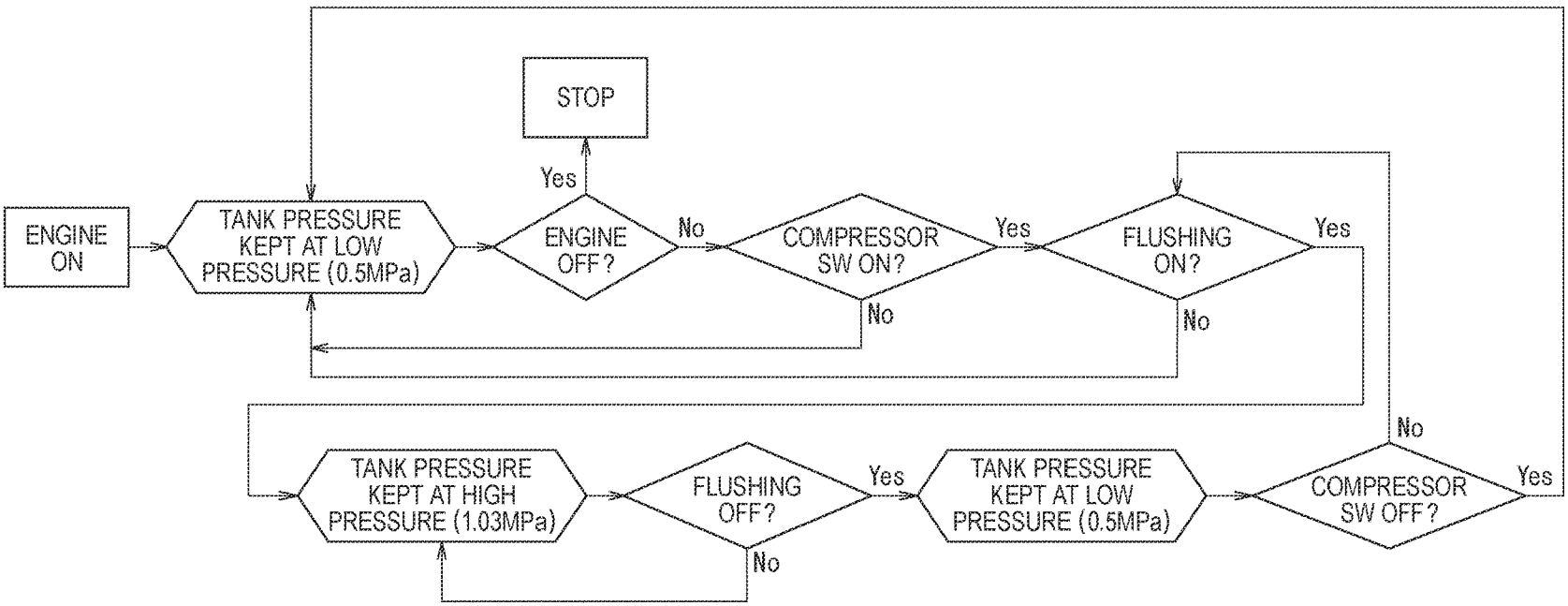
Figure 3B:
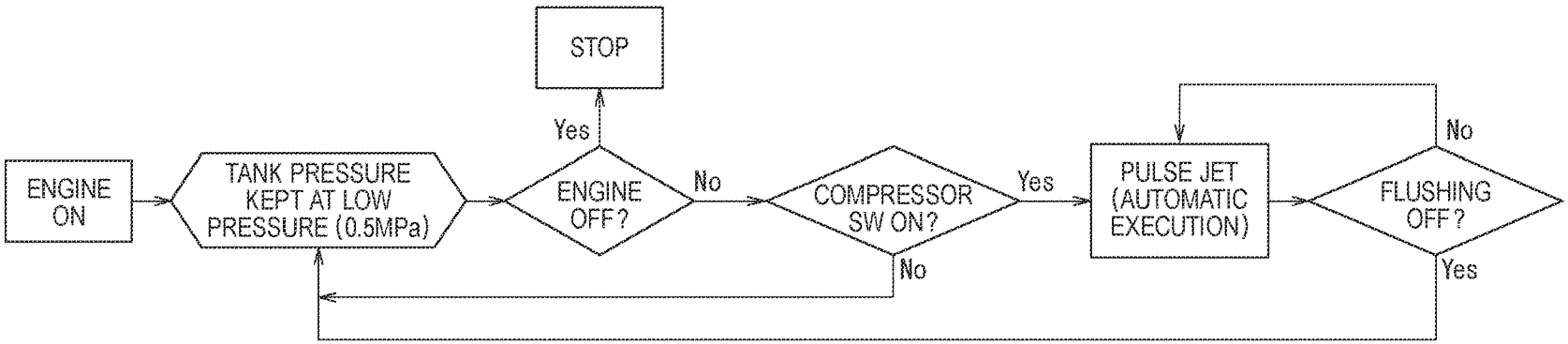

FIGS. 3A and 3B are schematic views illustrating processing procedures of the unload control in which importance is placed on fuel efficiency, impact on the environment, and the like. FIG. 3A illustrates a processing procedure when flushing is performed. FIG. 3B illustrates a processing procedure when a pulse jet is used.

First, in response to a manipulation by the operator or automatically in accordance with a preset condition, the automatic controller 20 starts up (turns on) the engine 21 of the crawler drill 1 and selects an operating mode of the processing procedure. When the engine 21 is driven, the compressor 16*a* starts operating in an interlocking manner.

When the engine 21 starts up, the low pressure unload control unit 20*a* in the automatic controller 20 starts processing. The low pressure unload control unit 20*a* in the automatic controller 20 performs unload control of the compressor 16*a* to bring the air pressure in the air tank 16*c* to the low pressure (0.5 MPa).

The automatic controller 20 turns on the compressor switch in response to a manipulation by the operator or automatically in accordance with a preset condition. The automatic controller 20 at least detects that the compressor switch has turned on. Even on this occasion, the low pressure unload control unit 20*a* in the automatic controller 20 continuously keeps the air pressure in the air tank 16*c* at the low pressure (0.5 MPa).

After the compressor switch turns on, the automatic controller 20, automatically in accordance with a preset condition, starts up (turns on) a pulse jet 22 that is used for cleaning of a bag filter or the like in a dust collector 14. While the compressor switch is being kept on, the pulse jet 22 can keep operating constantly or can operate intermittently (periodically for a certain period of time). Even on this occasion, the low pressure unload control unit 20*a* in the automatic controller 20 is continuously keeping the air pressure in the air tank 16*c* at the low pressure (0.5 MPa).

An injection orifice of the pulse jet 22 is provided in the dust collector 14. The pulse jet 22, after starting up, injects the compressed air of low pressure supplied from the air tank 16*c* to the inside of the dust collector 14. That is, dust removal by the pulse jet 22 is performed in the dust collector 14.

The automatic controller 20, in response to a manipulation by the operator or automatically in accordance with a preset condition, starts up (turns on) the flushing mechanism 17 of the crawler drill 1. The automatic controller 20 at least detects starting up (turning on) of the flushing mechanism 17.

The flushing mechanism 17, after starting up, performs flushing. When the flushing mechanism 17 starts up, the low pressure unload control unit 20*a* in the automatic controller 20 finishes processing and the high pressure unload control unit 20*b* in the automatic controller 20 resumes processing. That is, the control unit performing the operation is changed from the low pressure unload control unit 20*a* to the high pressure unload control unit 20*b*.

The high pressure unload control unit 20*b* in the automatic controller 20 performs unload control of the compressor 16*a* to increase the air pressure in the air tank 16*c* from the low pressure to the high pressure (1.03 MPa).

When the compressor switch is off, the flushing mechanism 17, even if starting up, does not operate (does not perform flushing) because the air pressure in the air tank 16*c* cannot be increased to the high pressure (1.03 MPa). Alternatively, the flushing mechanism 17 does not start up for the sake of safety. To start up the flushing mechanism 17, the compressor switch turns on.

Next, the automatic controller 20, in response to a manipulation by the operator or automatically in accordance with a preset condition, stops (turns off) the flushing mechanism 17. The automatic controller 20 at least detects a stoppage (turning off) of the flushing mechanism 17. The flushing mechanism 17 itself stopping operating causes flushing to be finished.

If a series of drilling operations is not finished (if an operation is continued), the high pressure unload control unit 20*b* in the automatic controller 20 finishes processing and the low pressure unload control unit 20*a* in the automatic controller 20 resumes processing when the flushing mechanism 17 is stopped. That is, the control unit performing the operation is changed from the high pressure unload control unit 20*b* to the low pressure unload control unit 20*a*.

The low pressure unload control unit 20*a* in the automatic controller 20 performs the unload control of the compressor 16*a* to decrease the air pressure in the air tank 16*c* from the high pressure (1.03 MPa) to the low pressure (0.5 MPa). For example, when the operator does not stop (turns off) the engine 21 within a certain period of time after the flushing mechanism 17 stops, the low pressure unload control unit 20*a* in the automatic controller 20 performs the unload control at the point when the above-described certain period of time has passed, decreases the air pressure in the air tank 16*c* from the high pressure to the low pressure, and keeps the air pressure in the air tank 16*c* at the low pressure. That is, the air pressure in the air tank 16*c* is not kept at the high pressure. Therefore, excessive energy necessary for keeping the air pressure at the high pressure can be reduced, and a burden on the compressor 16*a* and the air tank 16*c* can be reduced (wearing can be suppressed).

Next, the automatic controller 20, in response to a manipulation by the operator or automatically in accordance with a preset condition, stops (turns off) the compressor switch. The automatic controller 20 at least detects a stoppage (turning off) of the compressor switch. Even on this occasion, the low pressure unload control unit 20*a* in the automatic controller 20 continues keeping the air pressure in the air tank 16*c* at the low pressure (0.5 MPa).

After the compressor switch is turned off, the automatic controller 20 stops (turns off) the pulse jet 22 automatically in accordance with a preset condition. If a series of drilling operations is not finished (if an operation is continued), the low pressure unload control unit 20*a* in the automatic controller 20 continues keeping the air pressure in the air tank 16*c* at the low pressure (0.5 MPa) unless the flushing mechanism 17 starts up (turns on).

When a series of drilling operations is finished, the automatic controller 20, in response to a manipulation by the operator or automatically in accordance with a preset condition, stops (turns off) the engine 21. When the engine 21 is stopped, the compressor 16*a* and the automatic controller 20 are also stopped.

A program to make a computer execute the processing procedure of unload control as described above is referred to as a program for unload control. The program for unload control can be stored in a storage device and/or a storage medium. The program for unload control may be a resident program. In this case, the low pressure unload control unit 20*a* and the high pressure unload control unit 20*b* are always standing by except for duration in which the above-described operations are performed.

The low pressure unload control unit 20*a* and the high pressure unload control unit 20*b* may be individually achieved by running separate resident programs. Alternatively, the low pressure unload control unit 20*a* and the high pressure unload control unit 20*b* may be individually achieved by running objects in an object-oriented program or subroutines called by a main routine. The low pressure unload control unit 20*a* and the high pressure unload control unit 20*b* may be individually achieved by separate virtual machines (VM).

Although not illustrated in detail, the automatic controller 20 is achieved by a computer including a processor that is driven on the basis of the program for unload control and executes predetermined processing and a memory and a storage that store the program for unload control and various data. In practice, the low pressure unload control unit 20*a* and the high pressure unload control unit 20*b* in the automatic controller 20 may also be individually achieved by discrete independent computers.

Examples of the above-described processor include a CPU, a microprocessor, a microcontroller, a semiconductor integrated circuit having dedicated functions, and the like. Examples of the above-described memory include a semiconductor storage device, such as a RAM, a ROM, an EEPROM, and a flash memory. The above-described memory may be a buffer, a register, or the like. Examples of the above-described storage include an auxiliary storage device, such as an HDD and an SSD. The above-described storage may be a removable disk, such as a DVD, or a storage medium (media), such as an SD memory card.

The above-described processor and memory may be integrated. For example, recently, integration into a single chip, such as a microcomputer, has progressed substantially. Thus, a case is conceivable in which a single-chip microcomputer that is mounted on an electronic device or the like includes the above-described processor and memory. In practice, however, the configuration of the computer is not limited to these examples.

Although the above description was made using a crawler drill as an example, the above description is also applicable to a down-the-hole drill and a drill jumbo in practice. The above description is also applicable to other heavy machinery that performs the same unload control as a crawler drill.

The embodiment of the present invention was described in detail, but the present invention is not limited to the above-described embodiment in practice, and modifications without departing from the scope of the present invention are included in the present invention.

Figure 4A:
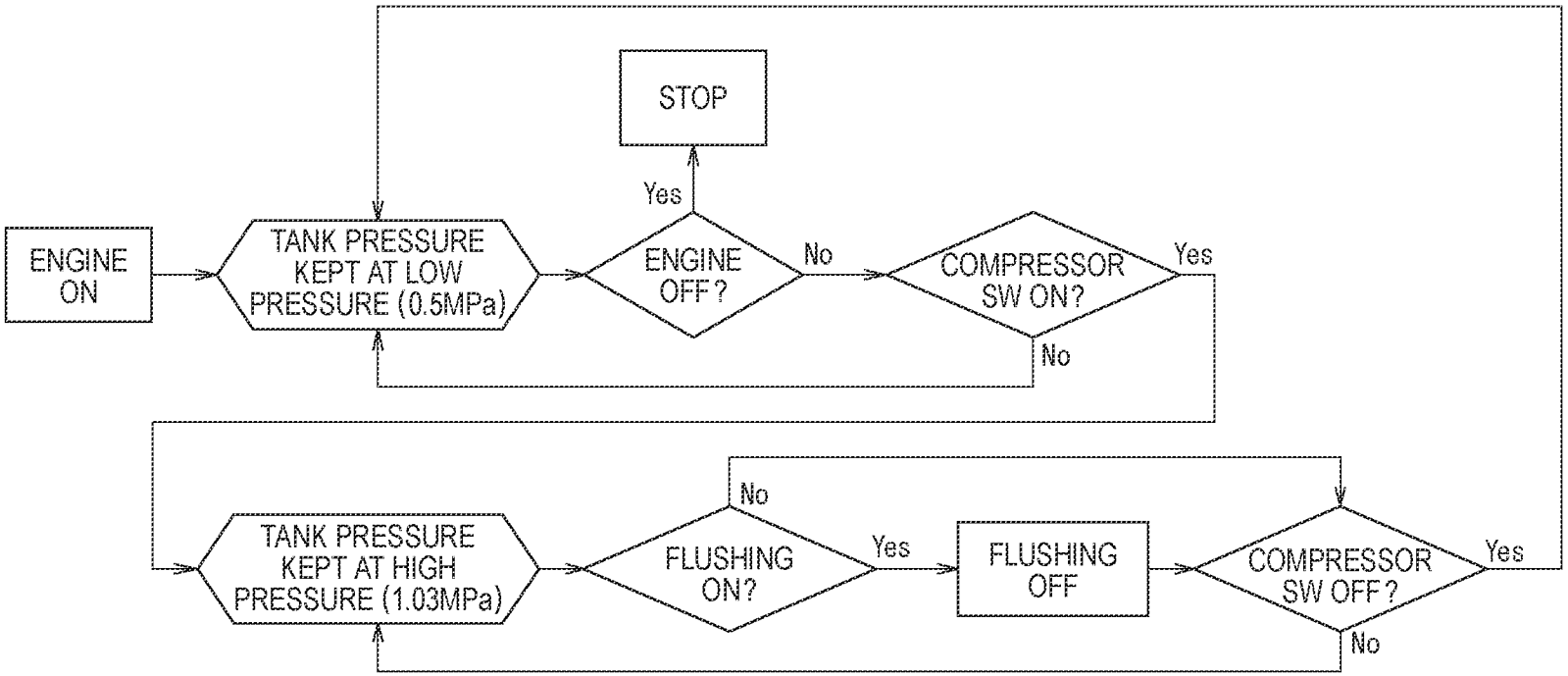
FIG. 4A is a schematic view illustrating a processing procedure (when flushing is performed) of the unload control in which the importance is placed on only efficiency of the drilling operation.
Figure 4B:
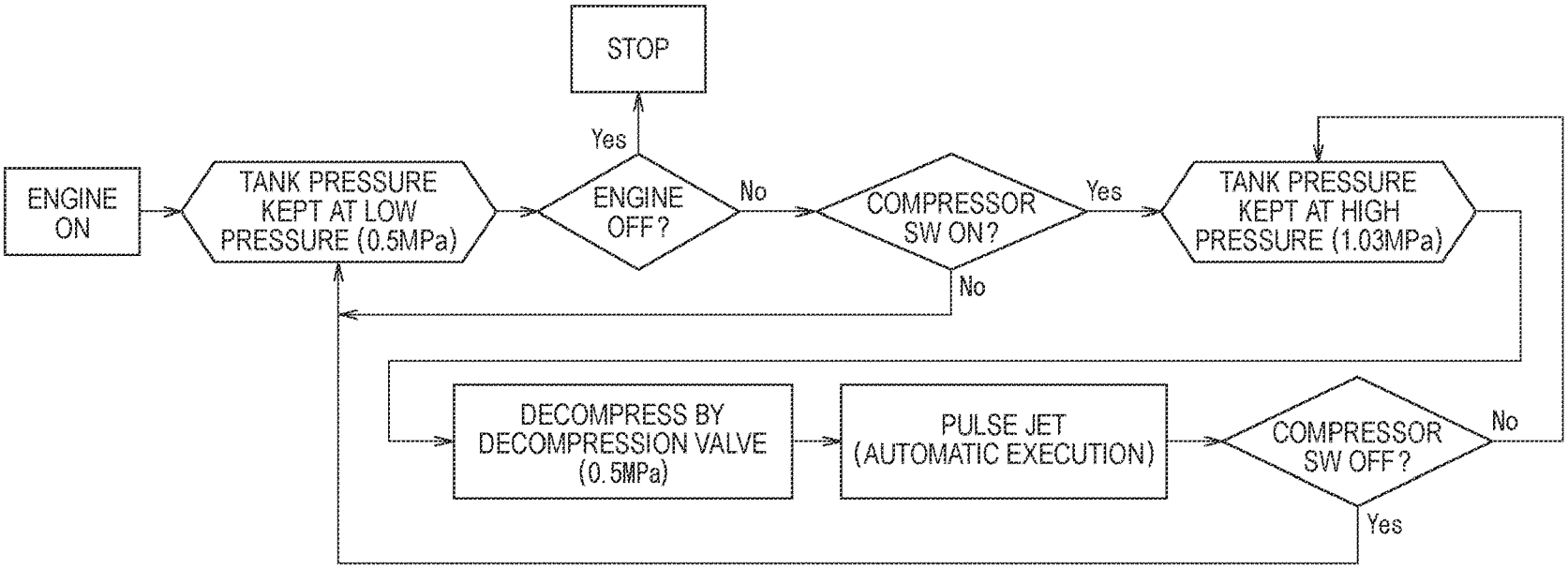
FIG. 4B is a schematic view illustrating a processing procedure (when a pulse jet is used) of the unload control in which the importance is placed on only efficiency of the drilling operation.

FIGS. 4A and 4B are schematic views illustrating processing procedures in known unload control in which importance is placed on only efficiency of drilling operation. FIG. 4A illustrates a processing procedures when flushing is performed. FIG. 4B illustrates a processing procedure when a pulse jet is used.

In a drilling device, a compressor starts operating in an interlocking manner at the same time as an operator starts up (turns on) an engine. At this time, the drilling device performs unload control of the compressor to bring air pressure in an air tank to a low pressure (0.5 MPa).

Next, when the operator turns on a compressor switch, the drilling device performs unload control of the compressor at the time, increases the air pressure in the air tank from the low pressure to a high pressure (1.03 MPa), and keeps the air pressure at the high pressure until the compressor switch is turned off.

When the compressor switch is turned on, a pulse jet starts operating automatically, and, after decompressing compressed air of high pressure supplied from the air tank to a predetermined air pressure by means of a decompression valve, injects the decompressed air into a dust collector. Even during a period from the time at which the operator starts up (turns on) a flushing mechanism to the time at which the operator stops (turns off) the flushing mechanism, the drilling device keeps the air pressure in the air tank at the high pressure.

Next, when the operator turns off the compressor switch, the drilling device performs unload control of the compressor, decreases the air pressure in the air tank from the high pressure to the low pressure, and keeps the air pressure at the low pressure until the compressor switch is turned on again.

When a series of drilling operations is finished, the operator stops (turns off) the engine.

Although, when efficiency in drilling operation is taken into account, the unload control as described above is sufficient, the unload control is not optimum when fuel efficiency, impact on the environment, and the like are taken into account.

On the other hand, in one embodiment of the present invention, although the procedure from the step of the drilling device bringing the air pressure in the air tank to the low pressure (0.5 MPa) at the start-up of the engine to the step of keeping the air pressure at the low pressure is the same as that in the conventional unload control, the air pressure in the air tank thereafter is kept at the low pressure until the flushing mechanism starts up (turns on), regardless of whether the compressor switch turns on or off (whether or not the pulse jet starts up), as illustrated in FIG. 3.

In one embodiment of the present invention, while the air pressure in the air tank is kept at the low pressure, the pulse jet injects compressed air of low pressure supplied from the air tank to the inside of the dust collector. That is, decompression by means of the decompression valve is not necessary.

The air pressure in the air tank is increased from the low pressure to the high pressure (1.03 MPa) only when the flushing mechanism starts up and keeps the high pressure thereafter. Further, the air pressure in the air tank is decreased from the high pressure to the low pressure when the flushing mechanism is stopped (turned off), and the air pressure in the air tank is kept at the low pressure until the flushing mechanism starts up next.

As described above, in the unload control in one embodiment of the present invention, even when dust removal is performed by the pulse jet, the air pressure in the air tank is kept at the low pressure unless flushing is performed, and the air pressure in the air tank is increased to the high pressure only when flushing is performed.

In addition, the unload control is configured so that the air pressure in the air tank being returned from the high pressure to the low pressure when flushing is finished causes a loss of energy to be further suppressed. Therefore, it is possible to perform optimum unload control from the viewpoints of fuel efficiency, impact on the environment, and the like.

A list of reference numbers in the drawings is described below.

1 crawler drill (drilling device)
2 carriage
3 boom
4 rock drill (drifter)
5 guide shell
6 striking mechanism
7 rotating mechanism
8 bit
9 rod
10 feed mechanism
11 rod changer
12 foot pad
13 suction cap
14 dust collector
15 hydraulic control unit
16 pneumatic control unit
16*a* compressor
16*b* suction valve
16*c* air tank
16*d* release valve
17 flushing mechanism
18 detector
18*a* rotational pressure detector
18*b* feed speed detector
18*c* feed pressure detector
18*d* striking pressure detector
18*e* flushing pressure detector
19 operator cabin
20 automatic controller (computer)
20*a* low pressure control unit
20*b* high pressure control unit
21 engine
22 pulse jet

The invention claimed is:

1. A drilling device comprising:

a compressor switch configured to switch air pressure in an air tank so as to bring the air pressure to a first air pressure when the compressor switch is off and to bring the air pressure to a second pressure when the compressor switch is on, wherein the second air pressure is higher than the first air pressure;

a first air pressure unload control unit configured to perform unload control of a compressor to bring air pressure in the air tank to the first air pressure when an engine starts up, and to keep the air pressure in the air tank at the first air pressure while the engine is being driven and a flushing mechanism is not driven whether the compressor switch is on or whether the compressor switch is off; and a second air pressure unload control unit configured to perform the unload control of the compressor to increase the air pressure in the air tank to the second air pressure when the flushing mechanism starts up and the compressor switch is on.

2. The drilling device according to claim 1, wherein the first air pressure unload control unit is configured to keep the air pressure in the air tank at the first air pressure, even when dust is removed by a pulse jet in a dust collector.

3. The drilling device according to claim 2, wherein the first air pressure unload control unit is configured to perform the unload control of the compressor to decrease the air pressure in the air tank from the second air pressure to the first air pressure when the flushing mechanism stops.

4. The drilling device according to claim 1, wherein the first air pressure unload control unit is configured to perform the unload control of the compressor to decrease the air pressure in the air tank from the second air pressure to the first air pressure when the flushing mechanism stops.

5. The drilling device according to claim 1, further comprising:

an engine switch configured to start up the engine;

a flushing switch configured to start up the flushing mechanism, wherein the engine and the compressor are directly connected with each other without a clutch interposed therebetween, wherein the first air pressure unload control unit is configured to perform the unload control of the compressor to bring the air pressure in the air tank to the first air pressure when the engine switch turns on, and to keep the air pressure in the air tank at the first air pressure even when the compressor switch further turns on and the flushing mechanism is not driven, and wherein the second air pressure unload control unit is configured to perform the unload control of the compressor to increase the air pressure in the air tank to the second air pressure when the flushing mechanism starts up and the compressor switch is on.

6. A non-transitory computer readable medium storing a program for unload control, causing a computer in a drilling device to execute a process comprising:

performing unload control of a compressor to bring air pressure in an air tank to a first air pressure when an engine starts up;

keeping the air pressure in the air tank at the first air pressure until flushing is performed whether a compressor switch is on or whether the compressor switch is off, the compressor switch configured to switch the air pressure in the air tank so as to bring the air pressure to the first air pressure when the compressor switch is off and bring the air pressure to the second air pressure when the compressor switch is on; and performing the unload control of the compressor to increase the air pressure in the air tank to a second air pressure that is higher than the first air pressure when the flushing is performed and the compressor switch is on.

7. The non-transitory computer readable medium according to claim 6, wherein keeping the air pressure in the air tank at the first air pressure includes keeping the air pressure in the air tank at the first air pressure even when dust is removed by a pulse jet in a dust collector.

8. The non-transitory computer readable medium according to claim 6, wherein the process further comprises:

performing the unload control of the compressor to decrease the air pressure in the air tank from the second air pressure to the first air pressure when the flushing is not performed; and keeping the air pressure in the air tank at the first air pressure until the flushing is performed next.

9. A drilling method comprising:

performing unload control of a compressor to bring air pressure in an air tank to a first air pressure when an engine starts up to keep the air pressure in the air tank at the first air pressure while the engine is being driven and a flushing mechanism is not driven whether a compressor switch is on or whether the compressor switch is off, the compressor switch configured to switch the air pressure in the air tank so as to bring the air pressure to the first air pressure when the compressor switch is off and bring the air pressure to a second air pressure when the compressor switch is on; and performing the unload control of the compressor to increase the air pressure in the air tank to the second air pressure that is higher than the first air pressure when the flushing mechanism starts up and the compressor switch is on.

* * * * *